US005547020A

United States Patent [19]

Sable et al.

[11] Patent Number: 5,547,020

[45] Date of Patent: Aug. 20, 1996

[54] CORROSION CONTROL WELL INSTALLATION

[75] Inventors: Donald E. Sable, Dallas; Donald E. Sable, II, Denton, both of Tex.

[73] Assignee: McClung-Sable Partnership, Dallas, Tex.

[21] Appl. No.: 398,530

[22] Filed: Mar. 6, 1995

[51] Int. Cl.[6] ..... E21B 41/02

[52] U.S. Cl. ..... 166/65.1; 166/241.4; 166/902; 204/196

[58] Field of Search ..... 166/65.1, 241.3, 166/241.4, 242, 902; 405/211.1; 204/147, 196

[56] References Cited

U.S. PATENT DOCUMENTS

| | | | |
|---|---|---|---|
| 2,310,757 | 2/1943 | Wagner | 166/902 X |
| 2,466,239 | 4/1949 | Holcombe | 166/902 X |
| 2,751,194 | 6/1956 | Rohrback et al. | 166/902 X |
| 2,846,385 | 8/1958 | Buchan | 204/148 |
| 3,734,181 | 5/1973 | Shaffer | 166/65.1 |
| 3,891,394 | 6/1975 | Smith et al. | 166/902 X |
| 4,088,183 | 5/1978 | Anzai et al. | 165/10 |
| 4,997,039 | 3/1991 | Sable | 166/241.4 |
| 5,191,938 | 3/1993 | Sable et al. | 166/241.3 X |

*Primary Examiner*—Roger J. Schoeppel

[57] ABSTRACT

Corrosion control cathodic protection for the rod string and the well tubing. Anode assemblies for mounting on the rods of the rod string.

16 Claims, 6 Drawing Sheets

CORROSION CONTROL WELL INSTALLATION

This invention relates to well installations and well tools and more particularly to well installations and well tools for minimizing corrosion damage to the rods and couplings of a pump operating rod string and to the well tubing, composed of tubing sections and tubing section couplings, through which the rod string extends and through which well fluids are pumped to the surface by a pump operated by the rod string.

BACKGROUND OF THE INVENTION

The rods of a rod string which is driven at the surface, either reciprocably or rotatably, by a prime mover to operate a submerged pump at the bottom of well tubing through which the rod string extends, are subject to corrosion as is the well tubing itself by chemical and electrochemical reactions. The problems and costs involved in replacing damaged rods, damaged couplings and damaged well tubing sections and tubing section couplings are so severe that many investigations have been conducted and many programs to minimize such damage have been prepared and implemented as is documented in such articles as "Sucker Rod Failures", Oil & Gas Journal, Apr. 9, 1973 edition; "How to Mitigate Corrosion and Abrasion Rod Pump Wells", Petroleum Engineer International, May 1991 edition; "Corrosion Control Programs", Petroleum Engineer International, October and November 1985 editions. Cathodic protection by use of sacrificial anodes or by impressed direct electric current in well installations has been disclosed in such U.S. Pat. No. 2,846,385 to R. C. Buchanan, Aug. 5, 1958, and U.S. Pat. No. 3,734,181 to Donald V. Shaffer, May 22, 1973, but the structures disclosed are of limited usage and in the case of the structures disclosed in the patent to Shaffer of complex design and limited efficacy.

The well tubing and the rods of the rod strings are subjected to corrosive action of chemicals present in the formation well fluids being pumped to the surface, such as hydrogen sulfide, carbon dioxide in the presence of water, and soluble salts, and also of chemicals which may be introduced into the tubing to stimulate well fluid flow, to reduce bacterial accumulations and the like.

The damage of the well tubing and the rod string by such chemicals is most prevalent in particular temperature and pressure zones in the well tubing determined by the types and concentration of the chemicals present in the fluids in the tubing. Such zones of corrosion damage to the tubing may be determined by caliper profiling methods an of both tubing and rod string by visual inspection when the rod string and the tubing are pulled from the well.

As is described in detail in the above mentioned articles, damage minimization is sought by use of special alloy steels for the tubing section and couplings and for the rods and couplings of the rod string, and by various coatings and inhibitors for the internal surfaces of the tubing sections and tubing couplings and for the rods and couplings of the rod string.

Where such coatings are used, any voids or breaks in the coatings, whether due to improper applications of the coating or due to damage during installation or handling of these components, become locations of corrosive damage. In the case of tubing, the corrosion may cause holes to be formed through the tubing. In the case of the rods, the corrosion may cause pits to be formed which therefore become locations of mechanical weakness in the rods and of rupture of the rods under the stresses to which the rods are subjected during pumping operations. Even where no coatings are employed, the corrosive damage at locations of nicks, scrapes or abrasions on the tubing and rods is greater than at unmarred smooth surfaces of the rod string and the well tubing.

OBJECTS OF THE INVENTION

It is an object of the invention to provide a new and improved means for providing cathodic protection, whether by sacrificial anode or by impressed direct electric current, for the pump operating rod string and for the well tubing along the portions thereof subject to corrosion by chemicals present in the fluids being pumped through such portions or lengths of the well tubing.

Another object is to provide cathodic protection means, of the type described, by providing selected portions or lengths of the rod string with longitudinally spaced anodes which are in electric contact with the rod string and have surfaces exposed to the liquids in the well tubing so that electric current may flow from the exposed anode surfaces through the liquids which, when corrosive, are electrolytes.

Still another object is to provide a cathodic protection means, of the type described, wherein the anodes are of a metal, e.g. zinc, having a more electro-negative potential than the metal, e.g. steel, of which the rod string and the well tubing are made, whereby, if the rod string and the well tubing are electrically connected at at least one pair of their adjacent ends either at the surface or down hole, electric current will flow from the exposed surface of the anodes, which are in this process corroded or sacrificed, through the electrolytic liquids to surfaces of the rod string and well tubing exposed to the electrolyte liquid and particularly subject to corrosion thus protecting such particularly vulnerable surfaces of the rod string and well tubing from corrosion.

Another object is to provide a cathodic protection system, of the type described, wherein the rod string and well tubing are not connected at their adjacent ends, whereby only the rods of the rod string provided with the sacrificial anode assemblies are protected thereby from corrosion.

Another object is to provide a cathodic protection means, of the type described, wherein a direct current voltage is impressed across the well tubing and the rod string, at the surface, which are insulated from one another, so that current can flow therebetween only through the electrolyte liquids in the well tubing, the tubing being electrically negative and the rod string electrically positive, the anodes on the rod string providing relatively short and therefore relatively low resistance paths for the electric current to flow through the electrolyte fluids in the well tubing.

An important object of the invention is to provide a new and improved anode assembly mountable on the shank of a rod of a rod string.

Another object is to provide an anode assembly, of the type described, having a tubular body of an electrically non-conductive substance rigidly securable on a rod shank, and an electrically conductive metal anode rigidly mounted on the tubular body and electrically connected to the rod shank.

Another object is to provide an anode assembly, of the type described, wherein the anode is of a metal having a more electro-negative potential than the metal of the rod.

Still another object is to provide an anode assembly, of the type described, wherein the tubular body has radially outwardly extending ribs for keeping the rod centralized relative to the well tubing in which the rod is located.

An important object is to provide a new and improved rod string and well tubing assembly wherein the anodes may be spaced varying distances from the well tubing so that the electrical resistances of the current flow paths between the anodes and the well tubing through the electrolyte fluids is varied in accordance with the degree of electrical resistance of the tubing string and well tubing to the location of the anode from the location of electrical connections of the rod string and well tubing at the surface or downhole at each such current flow path to ensure more uniform current flows at the locations of the anodes.

SUMMARY OF THE INVENTION

A cathodic protection installation for minimizing corrosion damage to the rod string and to the well tubing through which the rod strings extend having anodes mounted on the rod strings at selected locations therealong with the anodes being sacrificial anodes, to protect only the rod string at such locations or both the rod string and the well tubing depending on whether the tubing and rod string is electrically isolated at their ends or are electrically connected; or having a direct electrical current means for impressing an electric voltage across the well tubing and the rod strings which are electrically isolated from one another, the anodes being mounted in electrical connection with the rods of the string and thus providing current flow paths thereat from the rod string through the fluids to the well tubing.

An anode assembly having a rigid electrically non-conductive body rigidly mounted on the shanks of a rod and a metal anode mounted on the body and electrically connected to the rod.

DESCRIPTION OF THE DRAWINGS

Other Objects and Advantages of the invention will be readily apparent from the reading of the following description of well installations and anode assemblies constructed in accordance with the invention and reference to the accompanying drawings, wherein:

Referring now to FIGS. 1 through 5 of the drawings, the well 10 has the conventional surface equipment including the casing head 11 rigidly secured to the top of the casing C which extends downwardly through the well bore WB. The tubing T, through which the well fluids are pumped to the surface, has its upper and rigidly secured to the tubing head 12 itself rigidly secured to the casing head by a plurality of bolts 14 which extend through aligned holes in the flanges 15 and 16 of the casing and tubing heads, respectively. A gasket 18 is interposed between the tubing and casing heads to seal therebetween. The tubing and the casing thus form an annular passage AP therebetween closed at its top end. A pair of pipes 19 and 20 are threaded in suitable nipples of the casing to permit injection into or removal of fluids from the annular passage AP.

Figure 1:
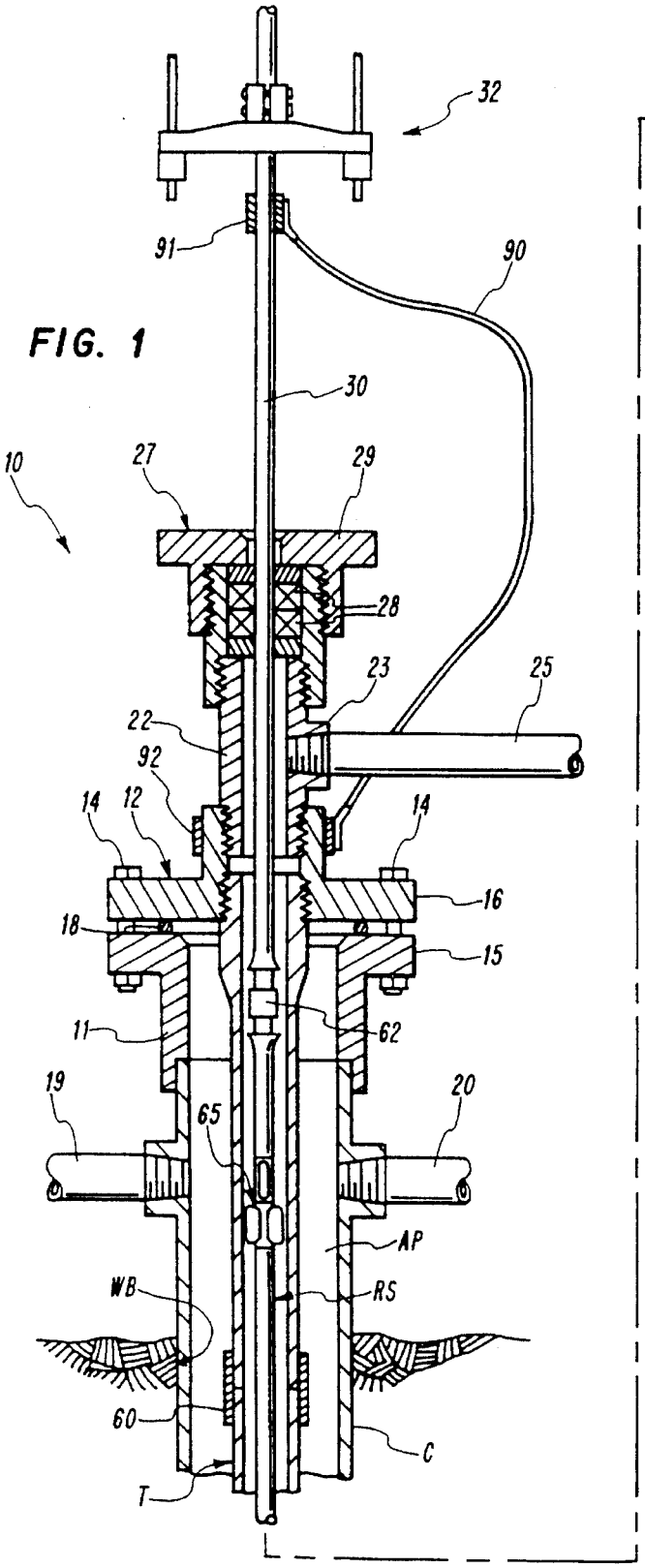
FIG. 1 is a vertical sectional schematic view of a well installation having the sacrificial anode assemblies of the invention on selected rods of its rod string.

If desired a suitable packer, now shown, is often employed to close the annular passage AP at its lower end.

The tubing head 12 has a tubular sub 22 connected thereto into whose nipple 23 is threaded a pipe 25 through which the pumped well fluids are transported to storage tanks or pipe lines.

A stuffing box assembly 27 is mounted on the sub 22 and has seal rings 28 which are compressed by the usual compressor member 29 into sealing engagement with a polished rod 30 which constitutes the top section of the rod string RS. A conventional hanger or clamp assembly 32 connects the polished rod, by means of cables 35 and 36, to the usual prime mover or walking beam which alternately pulls the rod string RS upwardly and then allows it to be moved downwardly by gravity.

A pump P, which may be of the type designated RHB by the American Petroleum Institute, is mounted in the lower end portion of the tubing in the conventional well known manner and includes a barrel 40 and a traveling plunger 41 slidable in the barrel and connected by a coupling 43 to the lowermost rod 44N of the rod string RS. The plunger and barrel have ball valve and seat assemblies 47 and 48, respectively. The operation and structure of this conventional pump being well known, they will not be described in greater detail.

Figure 2:
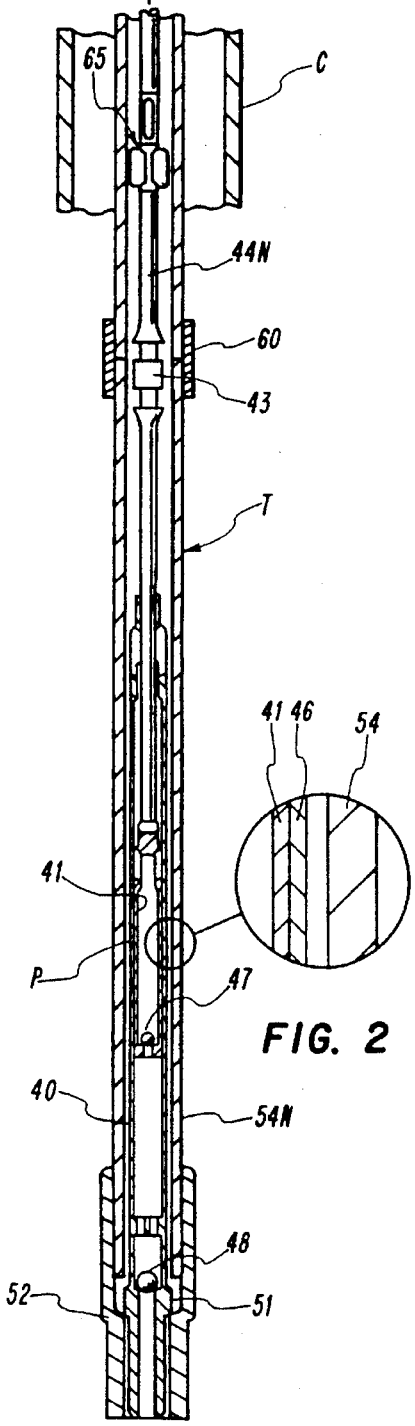
FIG. 2 is an enlarged fragmentary sectional view of the portion of the pump shown in FIG. 2.

As seen in FIGS. 1 and 2, the plunger and barrel of the pump have sliding metal to metal electrical contact with one another and the barrel has metal to metal contact, as at 51, with the barrel anchor 52 connected to the bottom tubing sections 54N.

The tubing T is composed of a plurality of tubing sections 54 connected by the usual tubular couplings 60, which provide electrical connection of the tubing sections. The rods of the rod string are connected to one another structurely and electrically by couplings 62.

In accordance with the invention, at least some of the rods of the rod string extending through portions of its tubing in which the pumped fluids are harmfully corrosive, due to such conditions as the temperatures, pressure, degrees of concentration of the corrosive agents and the like, are provided with anode assemblies 65 of this invention.

Figure 3:
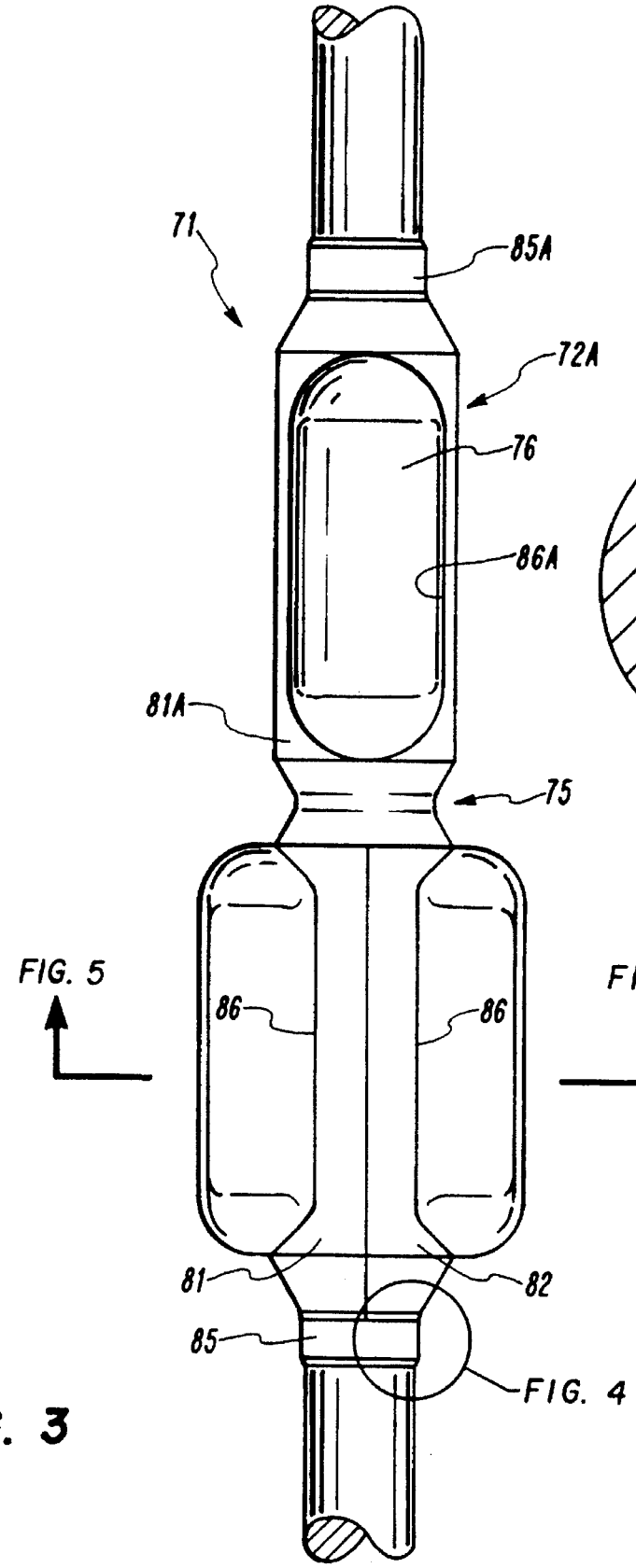
FIG. 3 is a plan view of an anode assembly embodying the invention.
Figure 4:
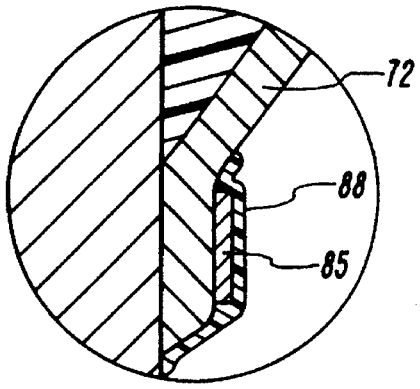
FIG. 4 is an enlarged fragmentary sectional view of a portion of the assembly of FIG. 3.
Figure 5:
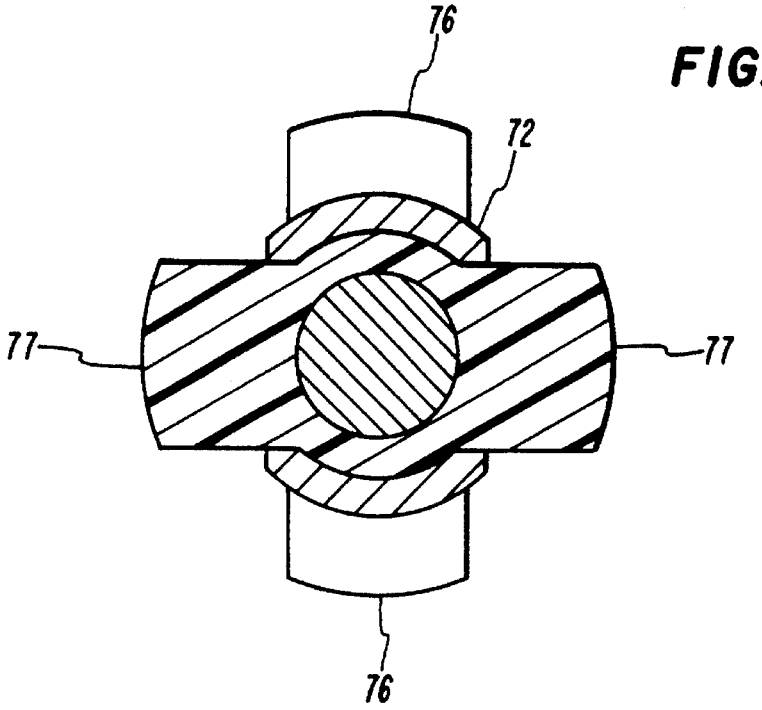
FIG. 5 is a sectional view taken on line 5—5 of FIG. 3.

Referring now particularly to FIGS. 3, 4 and 5 of the drawings, each sacrificial anode assembly 65 includes a centralizer 71, of the type described and illustrated in the U.S. Pat. No. 4,997,039 and sacrificial anode 72 and 72*a* of a more negative electrical potential metal than the steel or steel alloy metal of the rod string and tubing. For example, zinc or zinc alloys such as those described in CORROSION, Volume 2, Corrosian Control, published by Newnes-Butterworth of London and Boston, are used to manufacture the sacrificial anodes 72.

As is described in the above referenced patent to Sable, the centralizer 71 is formed of a hard, durable plastic, such as is commercially available under the trademark "RYTON," and has a longitudinal tubular body 75, an upper pair of ribs 76 extending outwardly from the body in opposite directions and a lower pair of ribs 77 displaced ninety degrees on the bodies 75 relative to the upper pair and spaced below the upper pair. The body 75 has an intermediate portion 78 of reduced diameter between the upper and lower pairs of ribs.

A lower sacrificial anode 72 may comprise a pair of sections 81, semi-cylindrical in cross sections, each having a bottom semicircular collar portion 82 which are in electrical contact with the rod shanks, the collar portions being clamped to the rod by a clamp or strap 85.

The lower ribs 77 of the centralizer protrude outwardly through elongate slots 86 of the two anode sections.

The upper anode **72*a*** having the same construction as the lower anode, its elements have been provided with the same reference numbers, to which the subscript "a" has been added as the corresponding elements of the lower anode.

The semi-cylindrical anode sections are rigidly secured to the plastic tubular body 75 by a suitable adhesive or bonding agent such as an epoxy capable of withstanding the temperatures and chemical conditions in the well tubing. A coating or film of a suitable electrically nonconductive substance such as epoxy covers the collars and prevents seepage of liquids between the anode collar and the rod shank to ensure that the electrical contact of the collars to the rod shank is not broken or made of high electrical resistance.

In installations where it is desired to protect both the well tubing and the rods themselves from corrosion by corrosive agents in fluids being pumped through the tubing, the well tubing and the rod string are electrically connected at the surfaces by a cable 90 electrically connected to the upper end of the polished rod by a clamp 92 and to the tubing by a clamp 92 electrically connected to the tubing head 12. It is preferred that the gasket 18 electrically isolate the tubing head from the casing head and that the bolts be electrically isolated from the heads by any suitable means, such as insulation washers and sleeves (not shown) to prevent any possible stray electric current flow between the casing and the tubing which might affect operation of the corrosion control installation.

The rods of the rod string are provided with the sacrificial anode assemblies throughout the zones of potential corrosion activity by the corrosive agents in the fluids being pumped through the tubing, such zones being established by temperature, pressure, chemical and tubing internal diameter logging or by visual inspection when the rod string is pulled out of the tubing and if the tubing is pulled out of the casing.

The sacrificial anodes are held in centralized position in the tubing by the engagement of the pairs of ribs 76 and 77 with the internal surfaces of the tubing so that the anodes 72 and **72*a*** are spaced at known uniform distances from the internal surfaces of the tubing.

It will be apparent that the electrical resistance of the current flow path between any one anode and its tubing includes the resistance of its anode collar, the length of the rod string from the collar to the cable clamp 91, the cable 90, the cable clamp 92, the tubing head, the length of the tubing from the tubing head to the location of such anode, and the electrolyte between the anode and the internal surface of the tubing.

If the pump P is of the type illustrated in FIG. 1 of the drawings, another current flow path between such anode and the tubing is established downwardly through the tubing string, the plunger, through the metal to metal contact of the plunger with the barrel, the anchor means 51 and upwardly through the tubing to the location of such anode. In effect, two parallel electric circuits are thus established between such anode and the tubing at the locations of such anode in the tubing. Providing such parallel circuits decreases the effective electrical resistance between such anode and the tubing through the tubing string and the well tubing which are thus electrically connected at both their opposite ends and thus increases any current flow through the fluids from such anode to the tubing.

It will be apparent that the shorter the distance between this anode and the internal surface of the tubing, the lower will be the electric resistance of the fluid therebetween.

The electrical resistance of such current flow paths varies with the lengths of the rod string and tubing between the anodes and the end connectors of the tubing and the rod string and the variations in the resistance of the current flow paths of anodes at different spaced locations along the rod string may be compensated for by varying the distances between the tubing and the outer surfaces of the anodes. This may be done by using anode sections of different thicknesses or by shims interposed between the anode sections and their tubular bodies 75.

In use, the well tubing and the rod string are often coated, in the zones of the tubing of known corrosive activity of the fluids flowing through such zones, with corrosion resisting substances, films and inhibitors. Any gaps, cracks or abrasive of these coatings expose surfaces of the tubing and the rod string to the corrosive fluids and corrosion thereof occurs.

The sacrificial anodes are mounted on the rods of the tubing string which extend through such corrosion zones and the reciprocal travel of the rod string permits each sacrificial anode to protect a relatively long length of the tubing. In some cases, the reaction products of the corrosion of the sacrificial anodes form a coating over such exposed surfaces of the tubing which further limits any damage to the tubing and, of course, decrease the rate of consumption of the sacrificial anodes.

Similarly, if any gaps, cracks in or abrasions of the protective films or coating on the rod string expose some surfaces of the rods to the fluids, the current flow and reaction products from the sacrificial anodes to such exposed surfaces will prevent corrosion of the rod string at such surfaces, the sacrificial anodes closest to such exposed surfaces being, of course, consumed.

In the case of well installations where no protective coatings or films are employed, corrosive actions is often concentrated at the locations of cracks, dents and scrapes of the otherwise smooth surfaces of the well tubing and the rod string. In this case the protection afforded the tubing and the rod string is especially helpful in limiting corrosion damage to the tubing and the rod string and prolonging their useful life. Obviously, the consumption or corrosion of the sacrificial anodes is much greater for given corrosive activity of the well fluids in well installations where the tubing and the rod string are not provided with such protective coatings or films than where such coatings and films are provided. In this case, the tubing and the rod string are protected against corrosion at the expense of the increased rate of consumption or corrosion of the sacrificial anodes, since the large areas of exposed metal increase the rate of current flow from the anodes to such exposed surfaces of metal.

Figure 7:
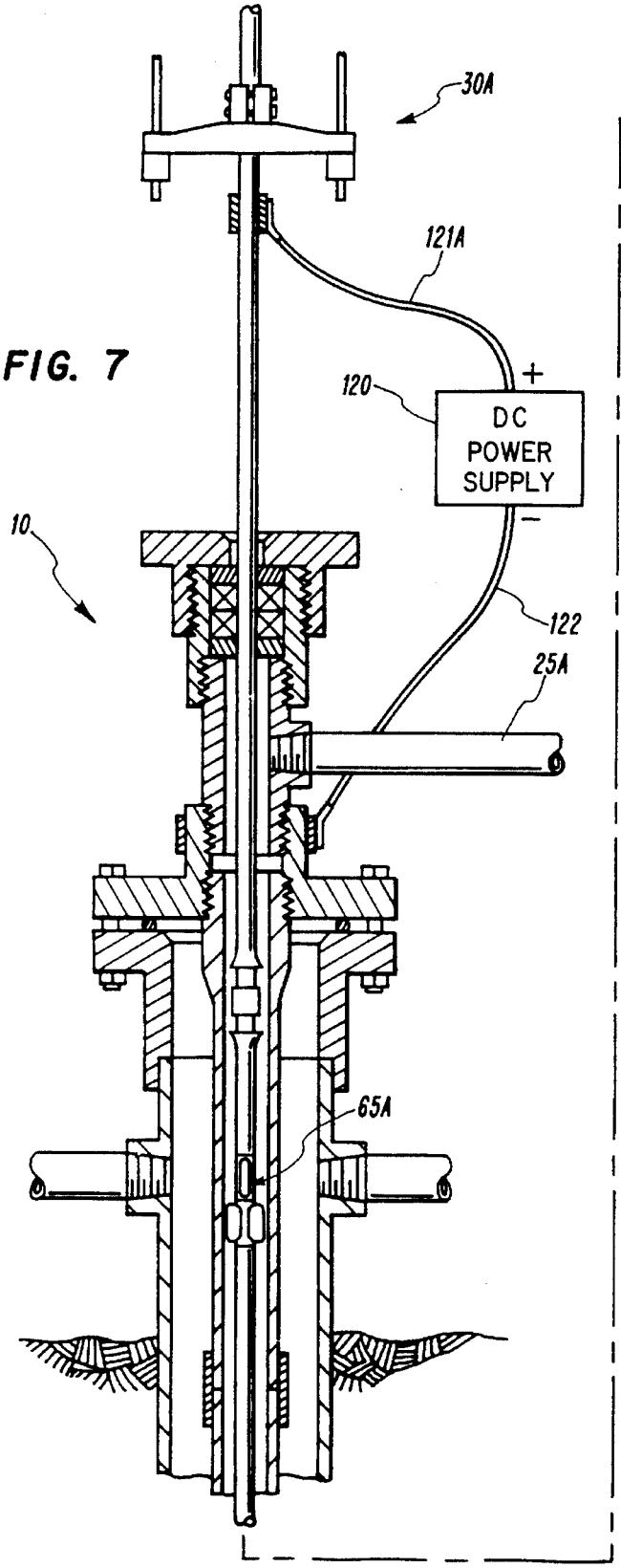
FIG. 7 is a vertical sectional view of another well installation having the anode assemblies of the invention.
Figure 8:
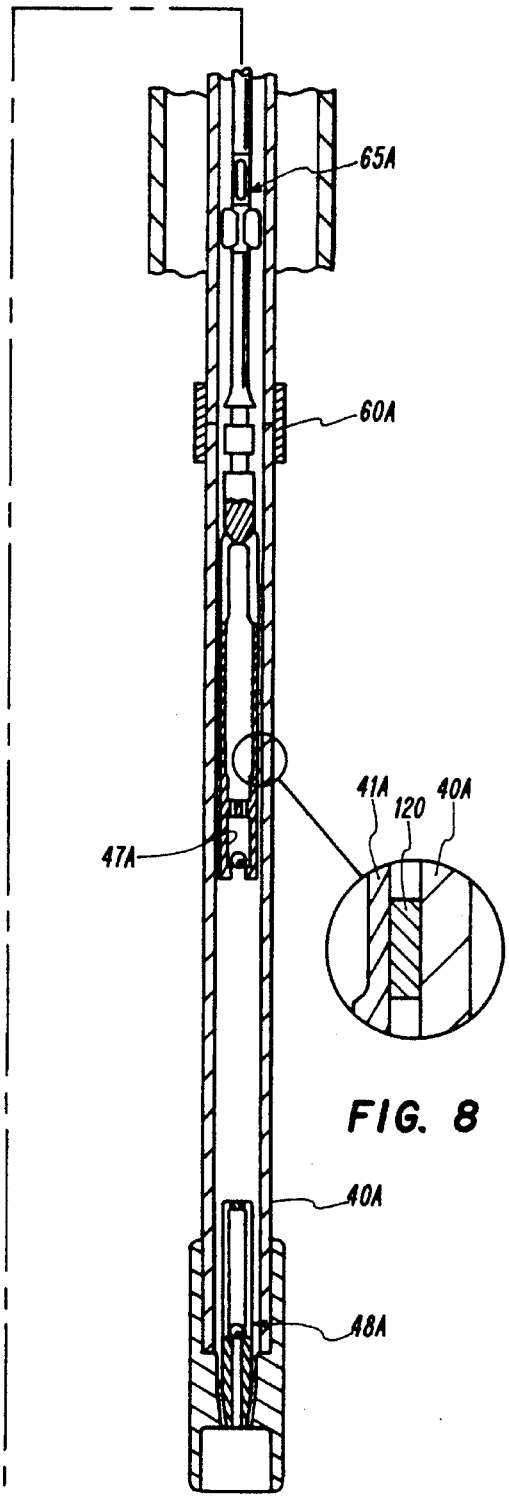
FIG. 8 is an enlarged sectional fragmentary view of the pump of FIG. 1.

Referring now to FIGS. 7 and 8, the well installation 10*a* being of substantially the same construction as the well installation 10 of FIG. 1, its elements have been provided with the same reference numerals, to which the subscript "a" has been added, as the corresponding elements of the well installation 10.

The well installation 10*a* differs from the well installation 10 in that the pump Pa is of the type designated TP by the American Petroleum Institute and its pump plunger 41*a* is electrically isolated from its barrel 40*a* by an electrically non-conductive seal or packing.

A direct current power supply 120 has its positive voltage terminal connected by a cable 121 to the polished rod of the rod string and its negative terminal to the tubing head by a cable 122.

The anodes of the anode assemblies may be formed of any suitable metal which will function properly as an anode.

It will be apparent that only the internal surfaces of the well tubing will be protected since the power supply will maintain the tubing at a negative voltage relative to anodes thus preventing corrosion of the well tubing as fully explained in the above referenced book CORROSION.

It will be apparent that the tubing is electrically insulated from the rod string, current flow between the tubing and the anodes taking place only through the fluids.

Figure 6:
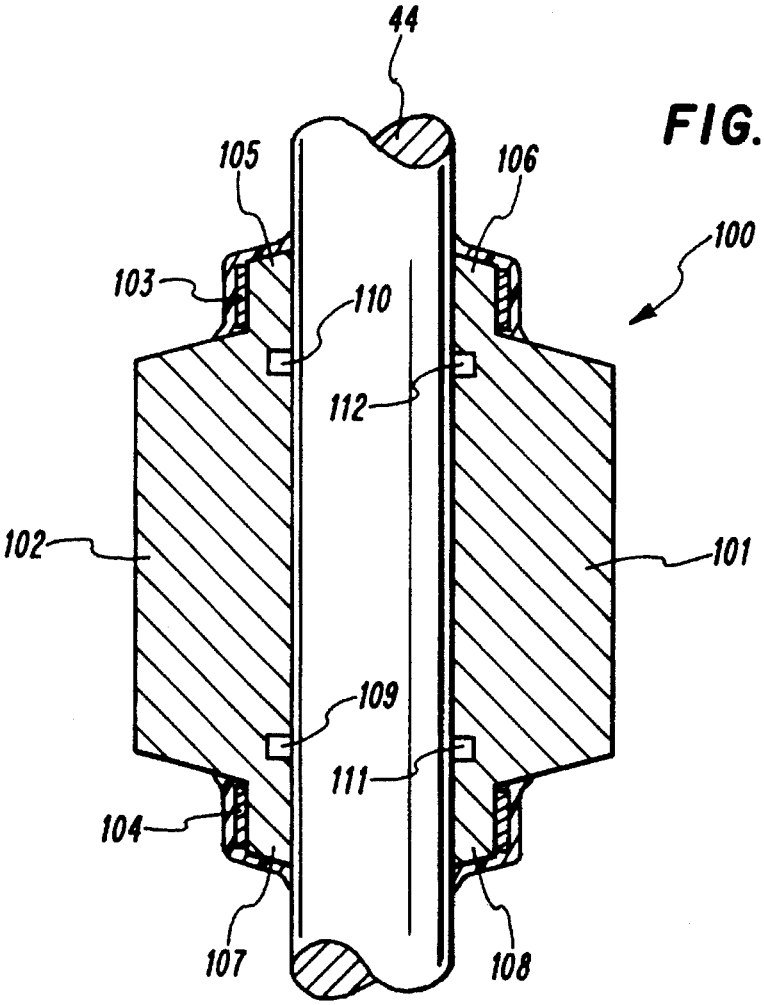
FIG. 6 is a sectional view of another form of the drive assembly.

Referring now to FIG. 6 of the drawings, the anode 100 may be mounted directly on the rod and has a pair of semi-cylindrical sections 101 and 102 which are clamped on the rod by straps or clamps 103 and 104. The strap 103 extends about the collar portions 105 and 106 and the strap 104 about the collar portions 105 and 106 of the two sections.

The anode sections may be rigidly secured to the rod by a suitable bonding or adhesive substance, such as an epoxy placed between the grooves 109 and 110 of the section 102 and the aligned with similar grooves 111 and 112 of the section 101. The grooves are provided to prevent excessive amounts of the bonding agent from flowing between the collar portions and the rod and thus electrically insulate the collar portions from the rod.

Such anodes 100 may be used on rotary, instead of reciprocating rod strings, in cooperation with centralizers like those shown in the U.S. Pat. No. 5,191,938 to Donald E. Sable and Donald E. Sable, II, issued Mar. 9, 1993, the centralizers holding the rod string in centralized position in the well tubing and thus the anodes 100 as well.

While the anodes of the anode assemblies 65 illustrated in FIGS. 3, 4 and 5 are shown mounted on a centralizer body having two pairs of longitudinally spaced ribs, it will be apparent the anodes may be mounted on such centralizers as shown in U.S. Pat. No. 4,088,183 whose circumferentially spaced radially outwardly extending ribs are not longitudinally spaced from one another.

Figure 9:
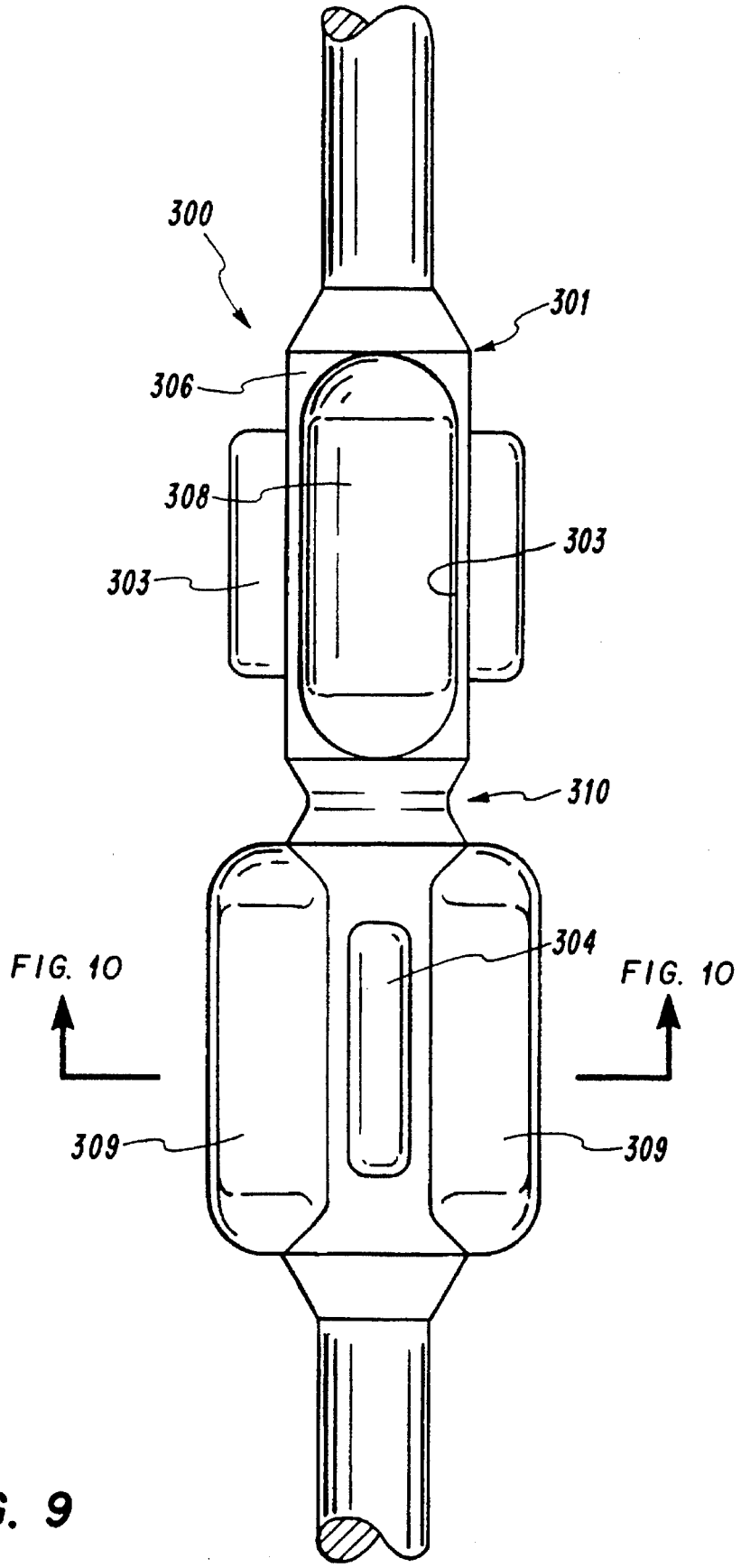
FIG. 9 is the plan view of another form of anode assembly embodying the invention.
Figure 10:
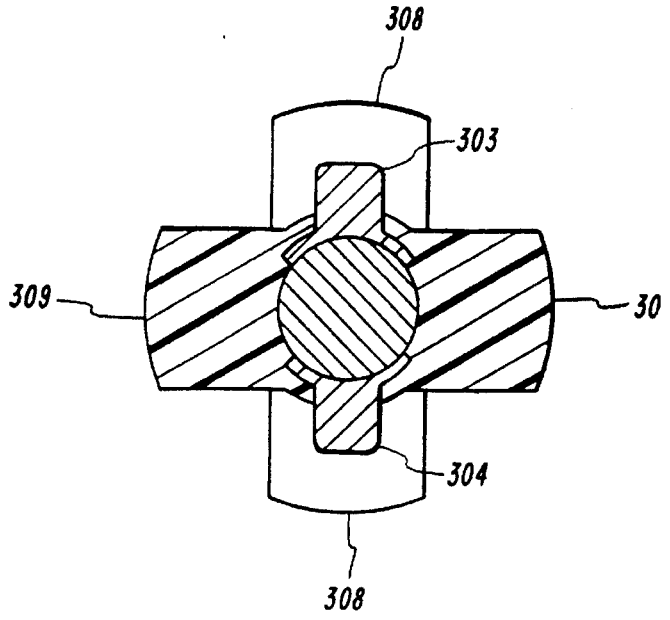
FIG. 10 is a sectional view taken on lien 10—10 of FIG. 9.
Figure 11:
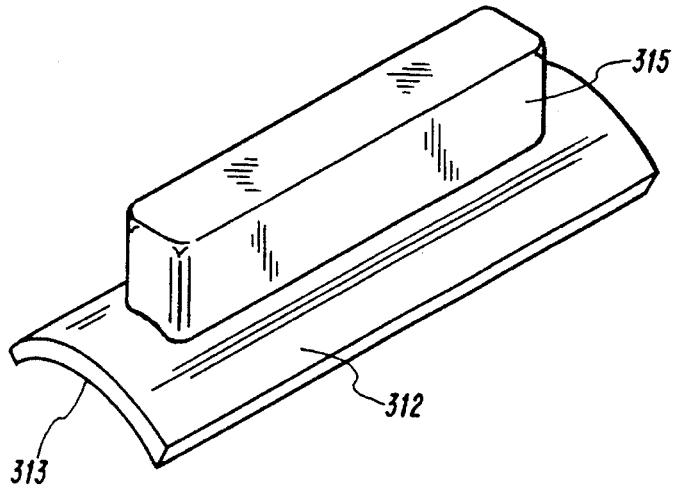
FIG. 11 is a perspective view of one of the anode elements of the assembly illustrated in FIGS. 9 and 10.

Referring now particularly to FIGS. 9, 10 and 11 of the drawings, the sacrificial assembly 300 includes, like the assembly illustrated in FIGS. 3, 4 and 5, a centralizer 301 of the type described and illustrated in the U.S. Pat. No. 4,997,039 to Donald E. Sable and upper and lower pairs of sacrificial anode sections or elements 303 and 304, respectively, formed of a more negative electrical potential material than the steel or steel alloy metal of the rod string and tubing. The centralizer 301 has a longitudinal tubular body 306, an upper pair of ribs 308 extending radially outwardly from the body in opposite direction, and a lower pair of ribs 309 displaced ninety degrees on the body 306 relative to the upper pair and spaced below the upper pair. The body has an intermediate portion 310 of reduced diameter between the upper and lower pairs of ribs.

Each of the sacrificial anode sections or elements is disposed between a pair of the centralizer ribs and has an arcuate inner portion 312 having an inner surface 313 of substantially the same radius as the radius of the rod. An outwardly extending rib integral with the portion 312 extends radially outwardly of the centralizer body 306. The anode element ribs 315 extend outwardly a shorter distance than the ribs of the centralizer and are thus protected by the ribs from contact with the tubing.

The anode elements are held in place in electrical contact with the rod by the body 306, the centralizer being molded about the anode elements in a suitable injection mold. The anode elements may be held in proper position by the mold itself or may be, if desired, held in position by a suitable adhesive during their assembly onto the rod before the centralizer is molded thereon.

It will be apparent that the arcuate portions 312 of the anode elements will be held in compressed engagement against the rod shank as the plastic material cools in the mold.

It will now be apparent that the anode elements may be formed as zinc or zinc alloy castings and that the plastic of the centralizer, as described above, may be of any suitable type such as is commercially available under the trademark "RYTON".

It will be apparent that the ribs 315 of the anode elements will have their outer surfaces exposed and in contact with the well fluids and will function as sacrificial anodes as explained above.

It sill now be seen that a new and improved corrosion control means has been illustrated and described for protecting rod strings and well tubing against corrosion by cathodic protection.

It will also be seen that a new and improved anode assembly for rod strings has been illustrated and described which holds cathodic protection anodes in proper concentric position in the tubing being protected.

Various changes and modifications may be effected in the illustrated embodiments of the invention without departing from the scope or spirit of the invention defined in the appended claims.

What is claimed as new and desired to be secured by Letters Patent is:

1. In a well tool installation having well tubing through which fluids are pumped to the surfaces by means of a string of rods which extends through the tubing to a submerged pump at the lower end of the tubing; a plurality of longitudinally spaced anode assemblies rigidly mounted on preselected rods of the string located in zones of corrosive activity of the fluids being pumped, said anode assemblies comprising a metal anode in electrical contact with the rod on which it is mounted; and means securing said anode to the rod on which said rod is mounted, wherein each of said anode assemblies comprises a rigid electrically nonconductive tubular body rigid with the rod, said anode being mounted on said tubular body and having a portion extending beyond said body and in electrically conducting engagement with the rod.

2. In the well installation of claim 1, wherein said tubular body has a plurality of circumferentially spaced radially outwardly extending ribs for engaging the tubing to maintain said assembly concentric in the tubing.

3. In the well installation of claim 2, wherein anodes of said assemblies at predetermined locations on said string of rods are spaced at radially different spaces from the rods on which they are mounted.

4. In the well installation of claim 1, wherein said anodes are of a metal having a more negative electric potential than that of the metal of the rods and the tubing, wherein each of said anode assemblies comprises a rigid electrically non-conductive tubular body rigid with the rod, said anode being mounted on said tubular body and having a portion extending beyond said body and in electrically conducting engagement with the rod.

5. In the well installation of claim 4, wherein said tubular body has a plurality of circumferentially spaced radially outwardly extending ribs for engaging the tubing to maintain said assembly concentric in the tubing.

6. In the well installation of claim 5, wherein anodes of said assemblies at predetermined locations on said string of rods are spaced at radially different spaces from the rods on which they are mounted.

7. An anode assembly rigidly mountable on the shanks of a rod of a well pump operating rod string, said anode assembly including: a pair of longitudinal anode sections positionable about the shank of a rod; and means for rigidly securing said sections to the rod, each of said sections having at least one portion thereof in electrical contact with the shank, each of said anode sections comprising an arcuate elongate portion having an inner arcuate surface of substantially the same radius of curvature as the radius of the rod shank on which it is to be mounted and a rib extending radially outwardly of said arcuate portion, each of said anode assemblies includes an electrically non-conductive tubular body rigid with said shank and about said arcuate portion of said anode section, said tubular body rigidly holding said anode section on the rod shank.

8. The anode assembly of claim 7 wherein said tubular body has circumferentially spaced radially outwardly extending ribs each of said anode sections being disposed between a pair of said ribs of said tubular body.

9. The anode assembly of claim 8 wherein said ribs of said tubular body extend outwardly of the ribs of the anode sections.

10. An anode assembly rigidly mountable on the shanks of a rod of a well pump operating rod string, said anode assembly including: a pair of longitudinal anode sections positionable about the shank of a rod; and means for rigidly securing said sections to the rod, each of said sections having at least one portion thereof in electrical contact with the shank, wherein each said anode assembly includes an electrically nonconductive tubular body rigid with the shank, said anode sections being rigidly secured to said tubular body, said one portion of said section extending longitudinally outwardly of an end of said tubular body.

11. The anode assembly of claim 10, wherein said tubular body has circumferentially spaced radially outwardly extending ribs, said ribs extending radially outwardly of said anode sections.

12. The anode assembly of claim 11, wherein said assembly includes a tubular body having two longitudinally spaced portions and an intermediate portion of reduced diameters, each of said body portions having an anode rigidly secured thereto, each of said anodes having a collar portion extending longitudinally outwardly of the body portion on which it is mounted and in electrical contact with the rod.

13. The anode assembly of claim 12, wherein each of said body portions has a pair of radially oppositely and outwardly extending ribs, the ribs of one of the body portions being displaced circumferentially relative to the ribs of the other of said body portions.

14. The anode assembly of claim 10 wherein said anode is of a metal having a more negative electrical potential than that of the metal of the rod on which it is mountable.

15. The anode assembly of claim 14, wherein said anode assembly includes an electrically nonconductive tubular body rigid with the shank, said anode sections being rigidly secured to said tubular body, said one portion of said section extending longitudinally outwardly of an end of said tubular body.

16. The anode assembly of claim 14, wherein said tubular body has circumferentially spaced radially outwardly extending ribs, said ribs extending radially outwardly of said anode sections.

* * * * *